United States Patent [19]

Riecken

[11] 4,300,294

[45] Nov. 17, 1981

[54] ARTICLE OF FOOTWEAR

[76] Inventor: George C. Riecken, 1400 Washington Ave., Evansville, Ind. 47714

[21] Appl. No.: 82,709

[22] Filed: Oct. 9, 1979

[51] Int. Cl.[3] ..... A43B 3/26; A43B 3/24; A43B 3/12

[52] U.S. Cl. ..... 36/97; 36/101; 36/11.5

[58] Field of Search ..... 36/97, 11.5, 100, 101, 36/50; 24/73 GC, 91, 201 SG

[56] References Cited

U.S. PATENT DOCUMENTS

| | | | |
|---|---|---|---|
| 2,200,080 | 5/1940 | Fein | 36/101 |
| 2,259,273 | 10/1941 | Smith | 36/11.5 |
| 2,642,677 | 6/1953 | Yates | 36/11.5 |
| 3,275,002 | 9/1966 | Scholl | 36/11.5 |
| 4,103,440 | 8/1978 | Lawrence | 36/101 |
| 4,200,997 | 5/1980 | Scheinhaus et al. | 36/11.5 |

*Primary Examiner*—Patrick D. Lawson
*Attorney, Agent, or Firm*—Jenkins, Coffey, Hyland, Badger & Conard

[57] ABSTRACT

An article of footwear being in the form of a sandle includes a platform, two straps anchored to the platform to secure the platform to a wearer's foot, and an expedient, such as a velcro strip, mounted to the edge of the platform for removably fastening an upper foot covering to the platform to convert the sandal to a shoe and vice versa. The sandal includes a sole, a heel provided on the sole, an arch-engaging loop, an ankle-encircling loop, and one or more toe-receiving loops. The sole, an arch, a wedged heel, and a plurality of channels for movably receiving the straps are formed in a single molded platform to reduce the number of fabrication steps and make the sandle lighter. Each of the loops is anchored to the sole for adjustably securing the sole to a wearer's foot and for adjustably engaging the toe or toes of the wearer's foot. The arch-engaging loop and the toe-receiving loops are formed by a first strap and the ankle-encircling loop is formed by a second strap. A buckle is carried by the first strap and cooperates with the second strap to adjustably connect the first strap to the second strap to secure the sole to the wearer's foot and to apply a corrective force to the toe or toes of the wearer's foot. The length of the first strap is variable to accommodate various sizes and shapes of wearer's feet by adjusting the position of the buckle.

17 Claims, 7 Drawing Figures

ARTICLE OF FOOTWEAR

In general, the present invention relates to articles of footwear, and more particularly to orthopedic footwear for treatment and convalescense of foot-related problems such as hallux valgus, splay foot, and hammer toe. Further, the article of footwear includes a removable upper foot covering to provide both cosmetic appearance and weather protection for the foot during treatment or convalescence.

In my U.S. Pat. No. 3,066,678, issued Dec. 4, 1962, I have disclosed an orthopedic sandal including a single toe-receiving loop for the treatment of hallux valgus. However, it has been discovered that the sandal disclosed in my prior patent is stiff, heavy, uncomfortable, and lacks versatility. While the sandal was useful for the treatment of hallux valgus, many other foot-related problems were incapable of being treated by the sandal because of the problems noted above.

Futhermore, after surgery, the foot has typically been placed in a plaster cast for convalescence, which greatly restricts the mobility of the patient. The article of footwear of the present invention can be used for convalescence and allows the patient to walk within a very short period of time after surgery.

In a broad concept of the present invention, there is provided an article of footwear which includes a platform, an upper foot covering, and means for removably fastening the upper foot covering to the platform to allow interchangeability of the foot covering.

An object of the present invention is to provide an article of footwear having the capability of being converted from a sandal to a shoe and vice versa and which also allows an upper foot covering to be interchanged for color and/or style or to be discarded and replaced with a new foot covering.

It is another object to provide an orthopedic sandal which includes a removable upper foot covering for cosmetic appearance and for protection of the foot against inclement weather during treatment and/or convalescence.

It is a further object of the present invention to provide an article of footwear being in the form of a sandal for the treatment and/or convalescence of foot-related problems including hallux valgus, splay foot, and hammer toe, which includes a sole, a heel, and two straps anchored to the sole forming one or more toe-receiving loops, an arch-engaging loop, and an ankle-encircling loop. The length of the strap forming the toe-receiving loops and the arch-engaging loop is variable to adapt the sandal to various sizes and shapes of wearer's feet. A buckle is carried by one of the straps and cooperates with the other strap to adjust the sizes of the various loops for securing the wearer's foot to the sole and for applying corrective forces to one or more of the toes, the arch, and the ankle of the wearer's foot.

Other features of the present invention include a single molded platform comprising a sole, an arch, a wedged and flared heel, and a plurality of channels for receiving straps for securing the sandal to the wearer's foot. A heel cup is formed in a rear-foot portion of the platform and includes sides for holding the wearer's heel in place when corrective forces are applied to the toes of the foot.

The formation of the sole, arch, and heel in a single platform eliminates the need for steel shanks, arch cookies, and separate heels, and makes the sandal lighter in weight, more flexible, and simpler in construction.

Two layers of foam cushioning made of thermoplastic materials are attached to the sole of the sandal and may be softened and molded to perfectly accommodate any deformity associated with a particular wearer's foot.

While certain features of the present invention have been specifically noted hereinabove, other features and advantages of the present invention will become apparent from the following detailed description of an embodiment, which description should be considered in conjunction with the accompanying drawings in which.

Hallux valgus is a deformity of the foot in which the great toe is turned abnormally outward. Many times a painful bunion will accompany hallus valgus, but not necessarily. Furthermore, hallux valgus is most frequently caused by improper footwear. However, it may result from an injury or a disease such as gout or rheumatoid arthritis. Hammer toe is a deformity of one of the toes (such as the second toe) resulting from permanent annular flexion of the toe. Typically, the toe has retracted to a curled position. Splay foot describes a foot abnormality wherein the foot is flattened or spread out and the metatarsal shaft bones of the foot are separated.

A sandal constructed in accordance with the present invention includes improvements for treating a wearer's foot having one or more of these conditions. The sandal may also be used as a splint for convalescence of the foot after surgery to correct one or more of the conditions described above. An improved strapping arrangement allows unlimited adjustment to accommodate swelling, bandages, or various sizes and shapes of the wearer's feet.

Figure 1:
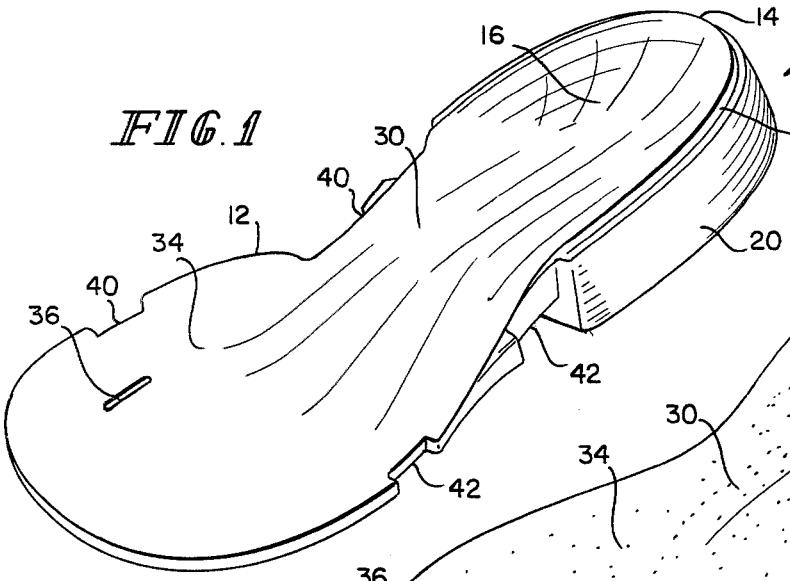
FIG. 1 is a top perspective view of a fabrication stage of an article of footwear constructed in accordance with the present invention.
Figure 3:
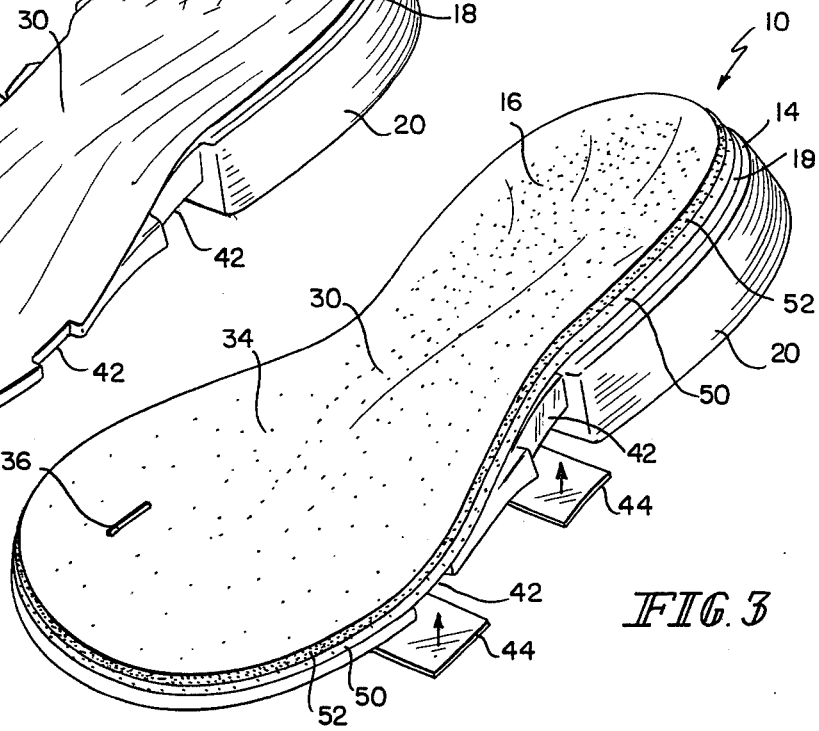
FIG. 3 is a perspective view of another fabrication stage of the article of footwear shown in FIGS. 1 and 2.
Figure 4:
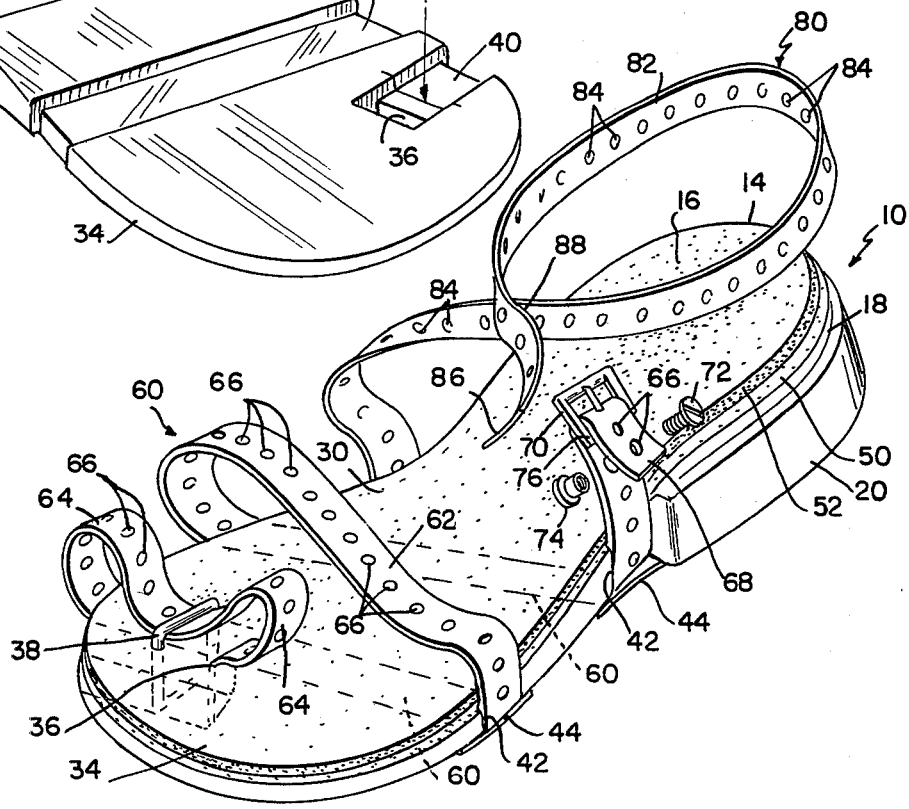
FIG. 4 is a perspective view of another fabrication stage of the article of footwear shown in FIGS. 1–3.
Figure 5:
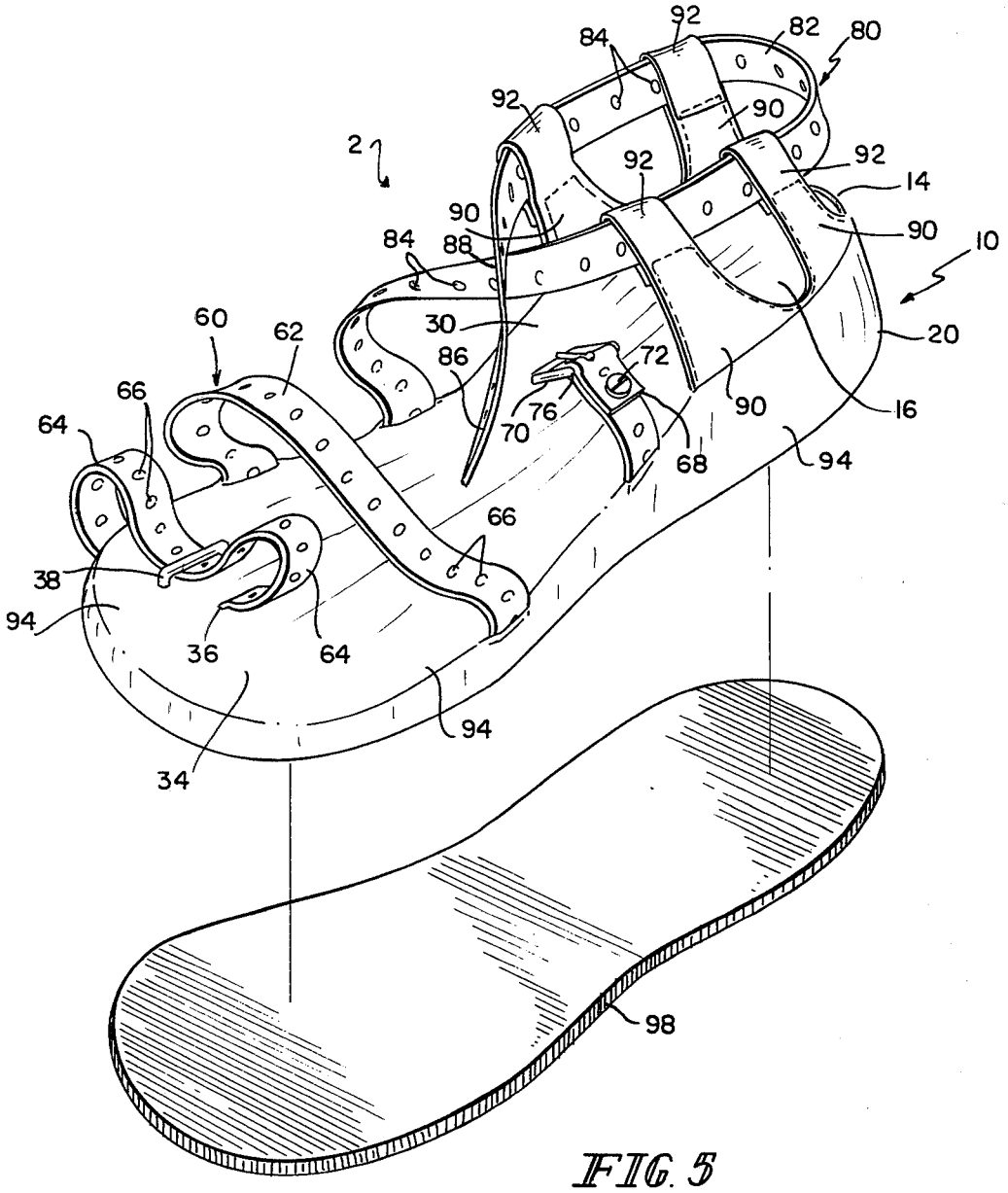
FIG. 5 is an exploded perspective view of the completed article of footwear constructed in accordance with the present invention

Referring in general to FIGS. 1–5, various fabrication stages of an orthopedic sandal 2 (see FIG. 5) constructed in accordance with the present invention are illustrated in there various Figs. Referring particularly to FIG. 1, a first stage in the fabrication of the sandal 2 illustrated in FIG. 5 is the formation of a platform or body block 10. In one embodiment, this platform 10 is molded from a lightweight cork material to give it flexibility and minimal weight. However, it will be understood that the platform 10 may be molded of other lightweight material without departing from the scope of the present invention.

Formed as an integral part of the platform 10 is a sole 12 having a rear foot portion 14 which includes a heel cup 16 of sufficient depth to provide sides 18 for holding the heel of a wearer's foot in place when corrective forces are applied to the toes in a manner to be described later. One of the major problems presently associated with applying corrective forces to the toe of a wearer's foot is the tendency of the wearer's heel to slide over the edge of the rear foot portion 14 of the sole 12. By forming a deep heel cup 16 in the rear foot portion 14 of the sole 12 having sides 18, more heel control is provided by the sandal 2.

Figure 2:
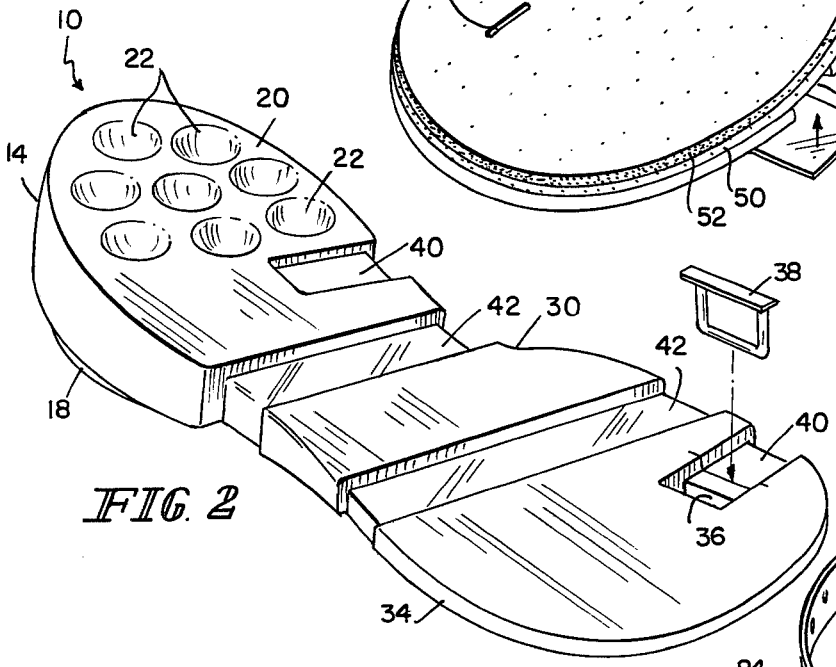
FIG. 2 is a bottom perspective view of the fabrication stage shown in FIG. 1.

The rear foot portion 14 further includes a wedged heel 20 which is flared slightly to the medial and lateral borders of the rear foot portion 14. The wedged heel 20 provides a natural arch shape to the sole 12 and the flaring of the heel 20 gives the sandal positive rear support to prevent the condition commonly known as running over or breaking down in the arch. As best illustrated in FIG. 2, a plurality of holes 22 are formed in the heel 20 to decrease the density and weight of the sandal 2.

The sole 12 also includes an arch 30 formed as an integral part of the platform 10 and having a natural arch shape produced by the wedged heel 20.

As can be appreciated, the formation of the sole 12, the wedged heel 20, and the arch 30 in a single molded platform 10 eliminates the need for a separate steel shank, arch cookie, or heel typically used in the conventional fabrication process of an article of footwear.

The sole 12 further includes a fore-foot portion 34 including a slot 36 formed in the platform 10 for anchoring a strap to the platform 10 to secure the wearer's foot to the platform 10. Referring specifically to FIG. 2, an anchoring pin 38 is attached to the fore-foot portion 34 to anchor the strap and form toe-receiving loops in a manner to be described later.

Referring to FIGS. 1 and 2, two channels 40 are formed in the platform 10 for receiving straps to be anchored to the platform 10. Two other channels 42 are also formed in the platform 10 for movably receiving the straps once they have been anchored by the anchoring pin 38 in the channels 40.

A second fabrication stage of the sandal 2 shown in FIG. 5 is illustrated in FIG. 3 wherein channel shields 44 are attached to the platform 10 to cover the two channels 42 for movably receiving the straps and provide a buffer between the straps and an outsole which may be attached to the platform 10. Preferably, these shields 44 will be constructed of a material which allows free movement of the straps within the channels 42, e.g., such as a MYLAR material. A bottom layer of foam cushioning 50 constructed of a thermoplastic material and having a shape generally equivalent to the shape of the platform 10 is attached to the platform 10. The material should have a density sufficient to maintain cushioning under the body weight of the wearer of the sandal 2. Attached to the bottom layer of foam cushioning 50 is a top layer of foam cushioning 52 also constructed of a thermoplastic material and having a shape generally equivalent to the shape of the platform 10. The top layer 52 should be sufficiently soft so that it conforms readily to the contours of the plantar surface of the wearer's foot. These two layers of foam cushioning 50, 52 give an even weight distribution to the sandal 2 with no particular pressure points. By using thermoplastic materials for the construction of the layers 50, 52, the insole can be heated, softened, and molded to perfectly accommodate the most extreme deformities of the wearer's foot. This can easily be performed by either the wearer or a physician attending the wearer by utilizing a heat gun or hot-air blower to soften the thermoplastic material.

Referring now to FIG. 4, a first strap 60 is positioned within the slot 36 formed in the fore-foot portion 34 of the sole 12 and anchored to the platform 10 by the anchoring pin 38 to form an arch-engaging loop 62 and one or more toe-receiving loops 64. As illustrated in FIG. 4, the anchoring pin 38 also provides a guide for forming two toe-engaging loops 64, one for applying a corrective force to the great toe and the other for applying a corrective force to the second toe. It will be understood that three additional toe-receiving loops 64 may be formed from strap 60 by attaching three additional anchoring pins 38 to the fore-foot portion 34 of the sole 12 to receive all five toes of a wearer's foot and allow corrective forces to be applied to each toe. The strap 60 is positioned in the channels 42 to form the arch-engaging loop 62 and a terminal portion 68 carried on one side of the platform 10. The entire length of the strap 60 includes perforations 66 for varying the length of the strap 60 to accommodate various sizes and shapes of feet. A buckle 70 is adjustably carried by the terminal portion 68 of the strap 60 by forming a buckle-retaining loop 76 and utilizing the perforations 66 to receive a male portion 72 and female portion 74 of a Chicago screw or soft-split rivet to hold the buckle in position. Importantly, the strap 60 can be cut and the buckle repositioned by simply removing the screw or rivet and reforming the buckle-retaining loop 76 to carry the buckle 70. Accordingly, the perforations 66, the buckle-retaining loop, and the screw or rivet allow unlimited adjustment of the toe-receiving loops 64 and the arch-engaging loops 62 to accommodate feet of various sizes and shapes.

A second strap 80 is also anchored to the platform in a channel 40 utilizing any conventional means for anchoring straps to shoe soles. As best illustrated in FIG. 4, the strap 80 is brought across the top of the wearer's foot to form an ankle-encircling loop 82. The second strap 80 also includes perforations 84 along its entire length and a terminal portion 86 which, in cooperation with the buckle 70 carried by the first strap 60, provides means for connecting the first strap to the second strap to secure the platform 10 to the wearer's foot. Importantly, it should be noted that the second strap initially crosses the upper portion of the foot, encircles the heel, and again crosses the upper portion of the foot at point 88 to provide positive support to the heel and secure the heel in position.

When the sandal 2 is fabricated, the straps 60 and 80 should be left extra long to allow fitting for different sizes and shapes of feet; however, once the foot has been positioned in the sandal 2 and various adjustments made to fit the sandal 2 to the foot, the unneeded portions of the straps may be cut off. These features give the orthopedic sandal 2 of the present invention considerable versatility with respect to its adaptation to treatment and convalescence of various sizes, shapes, and deformities of a wearer's foot.

The completely fabricated orthopedic sandal 2 is illustrated in FIG. 5, and further includes four short straps 90 attached to the rear foot portion 14 of the sole 12, two on either side 18 of the heel cup 16. These straps 90 are terminated in upper eyes 92 for receiving intermediate portions of the ankle-encircling loop 82 to restrict upward movement of the loop 82. This improved construction gives positive support to the heel and ankle of the wearer's foot.

As further illustrated, the platform 10 is provided with a decorative covering 94 and the construction of the molded platform 10 allows a variety of outsoles 98 to be easily attached to the platform 10 by either cementing or a vulcanizing process. In one embodiment of the sandal 2, a soft rubber threaded non-slip outsole is attached to the platform 10.

Use of the sandal 2 for treatment and/or convalescence can best be described by continuing to refer to FIG. 5. After the first strap 60 has been adjusted by positioning the buckle on the terminal portion 68 to accommodate for the particular size and shape of the wearer's foot, the wearer's foot will be placed through the ankle-encircling loop and the arch-engaging loop, and the toes within the toe-receiving loops 64. The terminal portion 86 of the second strap 80 is then positioned within the buckle 70, and the first strap is pulled tightly so that the toe-receiving loops 64 engage the toes and apply a corrective force to pull the great toe outward and straighten the second toe. The arch-engaging loop 62 engages the arch of the wearer's foot to apply corrective force and pull together the metatarsal bones of the foot. The overlapping of the ankle-encircling loop 82 at point 88 provides a positive support to the ankle and heel of the wearer's foot. Accordingly, pulling the first strap 62 and the second strap 82 and connecting the two straps utilizing the buckle 70 secures the wearer's foot to the platform 10 and applies corrective and supportive forces to the toes, arch, and angle of the wearer's foot. The four short straps 90 and the heel cup sides 18 (not shown in FIG. 5) hold the heel in a permanent position when the corrective forces are applied to the toes of the wearer's foot.

Figure 6:
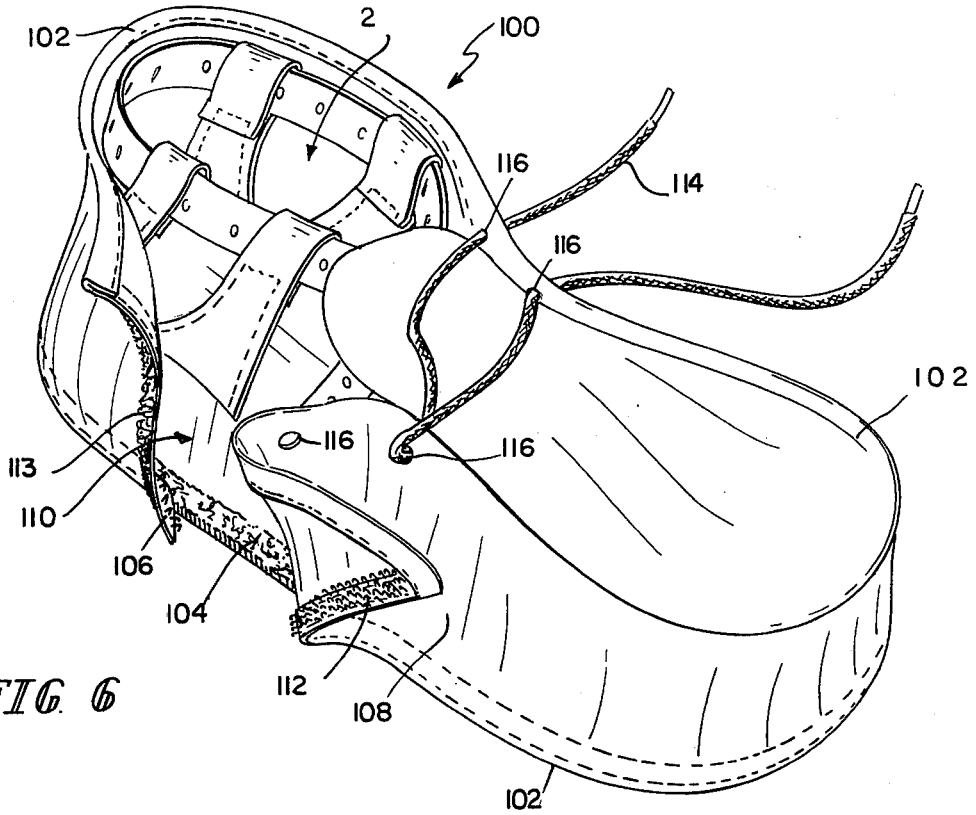
FIG. 6 is a perspective view of the article shown in FIGS. 1–5 illustrating its convertibility.

Illustrated in FIG. 6 is a covered article of footwear 100 which includes the orthopedic sandal 2 described hereinabove and illustrated in FIGS. 1–5. The covered article of footwear 100 includes an upper foot covering 102 which is removable for converting the orthopedic sandal 2 to a covered shoe 100 and vice versa. As previously discussed, the upper foot covering 102 gives the sandal 2 a cosmetic appearance and provides protection to the foot against inclement weather during treatment or convalescence. Mounted to the sandal 2 and the upper foot covering 102 are expedients for fastening the upper foot covering 102 to the sandal 2. In one embodiment, these expedients may include strips of velcro 104 edge-mounted to the sandal 2 and mounted to the bottom of the upper foot covering 102 in mating relationship for removably fastening the upper foot covering 102 to the sandal 2. One surface 108 of the upper foot covering 102 is slitted to form an opening 110 to facilitate the removal and fastening the covering 102 to the sandal 2. Provided on either side of the slitted opening 110 of the covering 102 are two velcro strips 112, 113, again positioned in mating relationship to close the opening 110 after the covering 102 has been fastened to the sandal 2. In one embodiment of the upper foot covering 102, a lace 114 is threaded through eyelet holes 116 provided on opposing sides of the covering 102 to allow the covering to be drawn together and provide a snug fit to the wearer's foot. It will be understood that other means may be provided in the covering for drawing it around the wearer's foot. Furthermore, various other means may be employed for fastening the upper foot covering 102 to the sandal 2 without departing from the scope of the invention. For example, snapping fasteners may likewise be mounted to the edge of the sandal 2 and to the bottom portion of the upper covering 102 in mating relationship to fasten the covering 102 to the sandal 2..

Figure 7:
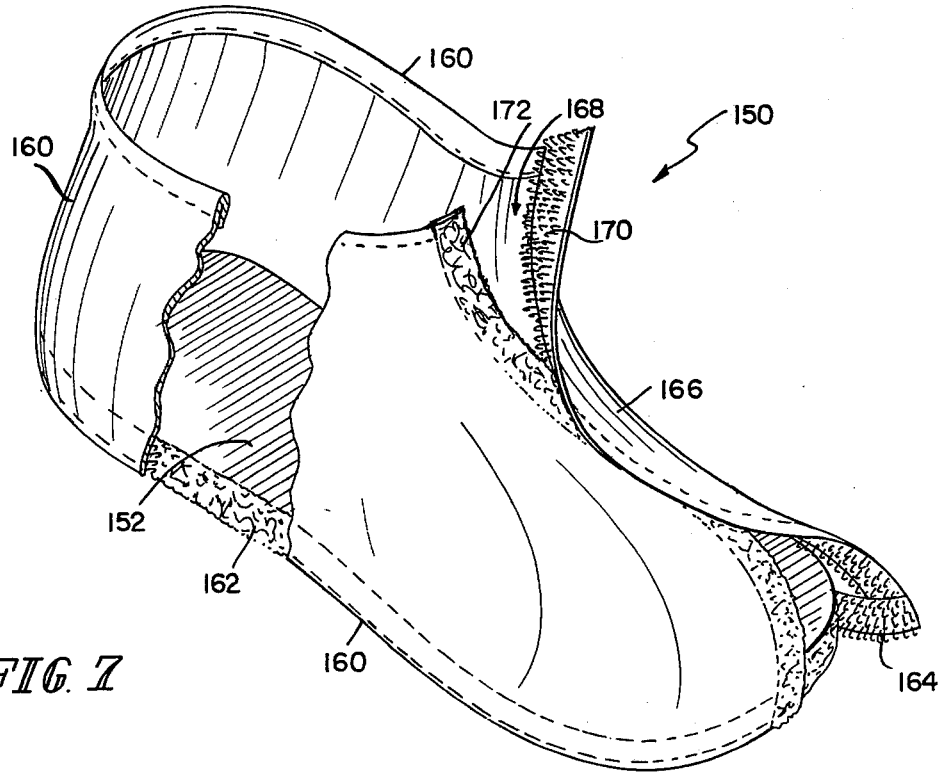
FIG. 7 is a perspective view of another embodiment of an article of footwear constructed in accordance with the present invention.

In another embodiment of the present invention, a versatile covered article of footwear 150 is illustrated in FIG. 7. The article of footwear 150 includes a platform or body block 152 which may or may not include means for securing the platform to the wearer's foot. An upper foot covering 160 which is interchangeable with other similarly constructed upper foot coverings 160 is removably fastened to the platform 152 in a manner similar to the fastening of the upper foot covering 102 to the sandal 2 as described hereinabove. The interchangeability of the upper foot coverings allows the wearer of the footwear to change the foot covering, for example, to change the coloring of the footwear. Again, velcro strips 162, 164 are mounted to the platform 152 and to the bottom of the upper foot covering 160 in mating relationship to provide means for fastening the foot covering 160 to the platform 152, although other fastening means may be employed without departing from the scope of the invention. A surface 166 of the covering 160 is slitted to provide an opening 168 for facilitating the removal and fastening of the covering 160 to the platform 152. As illustrated in FIG. 7, the slit has been provided on the top of the wearer's foot in such a fashion that the velcro strips function in a manner similar to a zipper. Importantly, however, it should be noted that various designs of platforms 152 and upper foot coverings 160 may be employed in accordance with this invention to provide a versatile covered article of footwear 150 wherein the upper foot covering 160 is interchangeable in accordance with the desires of the wearer of the footwear.

What is claimed is:

1. An article of footwear being in the form of a sandal comprising a sole; a heel provided on the sole; an arch-engaging loop, an ankle-encircling loop and at most one toe-receiving loop for adjustably securing the sole to a wearer's foot and for adjustably receiving at most one toe of the wearer's foot; the arch-engaging and toe-receiving loop being formed by a first strap having one end anchored adjacent to one lateral side of the sole; the ankle-encircling loop being formed by a second strap having one end anchored adjacent to the same lateral side of the sole as the first strap; and means for adjustably connecting the first strap to the second strap to secure the sole to the wearer's foot and to apply a corrective force to the one toe of the wearer's foot; the connecting means being carried by the first strap adjacent to another opposite lateral side of the sole.

2. The article as recited in claim 1 further comprising a single molded platform forming the sole, heel, an arch, and a plurality of channels for movably receiving at least the first strap.

3. The article as recited in claim 2 wherein the heel of the platform is wedged and flared at both medial and lateral borders of a rear foot portion of the platform to provide a natural arch shape and prevent rolling of the rear foot portion.

4. The article as recited in claim 3 wherein the sole of the platform includes a heel cup formed in the rear foot portion of the platform, the heel cup having sides for controlling the position of the wearer's heel in response to the corrective force applied to the wearer's toe.

5. The article as recited in claim 4 further comprising at least one layer of cushioning material applied to the sole of the platform to cushion and conform to contours of the plantar surface of the wearer's foot.

6. The article as recited in claim 5 further comprising a treaded outsole attached to the platform.

7. The article as recited in claim 1 further comprising a plurality of toe-receiving loops, each toe-receiving loop and the arch-engaging loop being formed by the first strap to apply a corrective force to the toes and arch of the wearer's foot by adjustably connecting the first strap to the second strap.

8. The article as recited in claim 1 further comprising means edge-mounted to the sole for removably fastening an upper foot covering to the sandal to thereby convert the sandal to a shoe.

9. The article as recited in claim 1 wherein the adjustable connecting means includes a buckle adjustably carried by the first strap to vary its length and the second strap is perforated along its entire length to cooperate with the buckle and adjustably connect the first and second straps to adapt the sandal to various sizes and shapes of wearer's feet.

10. The article as recited in claim 9 wherein a perforated terminal portion of the first strap includes a buckle-retaining loop for adjustably carrying the buckle and varying the length of the first strap.

11. The article as recited in claim 10 wherein the second strap loops across itself over the top of the wearer's foot to form the ankle-encircling loop and cooperate with the buckle to secure the sole to the wearer's foot.

12. The article as recited in claim 11 wherein a rear foot portion of the sole is provided with four short straps terminating in upper eyes for receiving intermediate portions of the ankle-encircling loop to restrict upward movement of the loop and provide heel support to the wearer's foot.

13. An article of footwear comprising a platform, a removable upper foot covering which includes an upper edge for encircling the ankle of the wearer's foot, a lower edge for engaging the platform, and two mateable side edges for opening and closing the foot covering to facilitate attachment and removal of the foot covering around the wearer's foot while the foot is maintained in position on the platform, and fastening means for securing the foot covering to the platform and adjusting the foot covering to irregular surfaces of the wearer's foot, the fastening means including interlocking members edge-mounted to the platform and to the lower edge of the foot covering in mateable relationship and interlocking members edge-mounted to the two side edges in mateable relationship.

14. The article as recited in claim 13 wherein the platform includes a sole, a heal provided on the sole, an arch-engaging loop, an ankle-encircling loop, and at least one toe-receiving loop for adjustably securing the wearer's foot to the platform and for adjustably receiving a toe of the wearer's foot, the arch-engaging, ankle-encircling, and toe-receiving loops being formed by two straps anchored to the sole, and means for adjustably connecting the straps to secure the wearer's foot to the platform and to apply a corrective force to the toe of the wearer's foot.

15. An article of footwear being in the form of a sandal comprising a sole having rear and front foot portions; a heel provided on the sole which is wedged and flared at both medial and lateral borders of the rear foot portion to provide a natural arch shape and prevent rolling of the rear foot portion; an arch-engaging loop, an ankle-encircling loop, and at least one toe-receiving loop for adjustably securing the sole to a wearer's foot and for adjustably engaging a toe of the wearer's foot; the arch-engaging and toe-receiving loops being formed by a first strap having one end anchored to the sole; the ankle-encircling loop being formed by a second strap having one end anchored to the sole; and means carried by the first strap for adjustably connecting the first strap to the second strap to secure the sole to the wearer's foot and to apply a corrective force to the toe of the wearer's foot; the connecting means being adjustably carried by the first strap to vary its length and thereby adapt the sandal to various sizes and shapes of wearer's feet.

16. An article of footwear being in the form of a sandal comprising a sole; a heel provided on the sole; an arch-engaging loop, an ankle-encircling loop and a plurality of toe-receiving loops for adjustably securing the sole to a wearer's foot and for adjustably engaging the toes of the wearer's foot; the arch-engaging loop and each toe-receiving loop being formed by a first strap having one end anchored to the sole; the ankle-encircling loop being formed by a second strap having one end anchored to the sole; and means carried by the first strap for adjustably connecting the first strap to the second strap to secure the sole to the wearer's foot and to apply a corrective force to the toes of the wearer's foot; the connecting means being adjustably carried by the first strap to vary its length and thereby adapt the sandal to various sizes and shapes of wearer's feet.

17. An article of footwear being in the form of a sandal comprising a sole; a heel provided on the sole; an arch-engaging loop, an ankle-encircling loop and at least one toe-receiving loop for adjustably securing the sole to a wearer's foot and for adjustably engaging a toe of the wearer's foot; the arch-engaging and toe-receiving loops being formed by a first strap having one end anchored adjacent to a lateral border of the sole; the ankle-encircling loop being formed by a second strap having one end anchored adjacent to the same lateral border of the sole as the first strap; and means carried by the first strap for adjustably connecting the first strap to the second strap to secure the sole to the wearer's foot and to apply a corrective force to the toe of the wearer's foot; the connecting means being adjustably carried by the first strap to vary its length and thereby adapt the sandal to various sizes and shapes of wearer's feet.

* * * * *